US005971790A

United States Patent [19]

Rohde

[11] Patent Number: 5,971,790

[45] Date of Patent: Oct. 26, 1999

[54] UNITARY SPRING LATCH FOR AN ELECTRICAL CONNECTOR ASSEMBLY

[75] Inventor: Carl William Rohde, Elizabethtown, Pa.

[73] Assignee: The Whitaker Corporation, Wilmington, Del.

[21] Appl. No.: 08/963,671

[22] Filed: Oct. 31, 1997

[51] Int. Cl.[6] ..... H01R 13/627

[52] U.S. Cl. ..... 439/357; 439/350

[58] Field of Search ..... 439/350–358

[56] References Cited

U.S. PATENT DOCUMENTS

| | | | |
|---|---|---|---|
| 4,367,003 | 1/1983 | Frantz | 439/350 |
| 4,568,135 | 2/1986 | Frantz | 439/350 |
| 5,383,794 | 1/1995 | Davis et al. | 439/352 |
| 5,494,452 | 2/1996 | Matsumoto et al. | 439/358 |
| 5,775,931 | 7/1998 | Jones | 439/358 |
| 5,788,528 | 8/1998 | Orr, Jr. et al. | 439/358 |
| 5,833,485 | 11/1998 | Steinhauser et al. | 439/358 |

OTHER PUBLICATIONS

*Cory CQ Connector Disclosure,* five pages; Jan. 1996; Cory Components Inc., El Segundo, CA.

U.S. Patent Application Serial No. 08/770,105 filed Dec. 19, 1996 (Abstract and Drawings only included).

*Primary Examiner*—Hien Vu
*Attorney, Agent, or Firm*—Anton P. Ness

[57] ABSTRACT

Spring latch (30) for a connector assembly (10) having an engagement section (40,42) at a forward end (38) to latch to a post (24) of a mating connector (22), to maintain the connectors in mated engagement. Forward end (38) comprises a pair of beams (50) coextending to respective transverse feet (40), the beams and feet separated by a slot (48) extending rearwardly along a body section (42). Beams (50) are pried apart during mating as inner edges of feet (40) bear against tapered side surfaces (56) of the forward end (26) of a post (24) of the mating connector (22), until full mating when feet (40) seat into an annular groove (28) rearwardly of the post forward end (26).

6 Claims, 3 Drawing Sheets

UNITARY SPRING LATCH FOR AN ELECTRICAL CONNECTOR ASSEMBLY

FIELD OF THE INVENTION

The present invention is related to the field of electrical connectors and more particularly to latching springs therefor.

BACKGROUND OF THE INVENTION

An electrical connector assembly is known having a pair of latching springs secured within a shell enclosing an electrical connector; one such connector assembly is the AMPLIMITE HDP Crimp Snap-In Contact connector sold by AMP Incorporated, Harrisburg, Pa. The latching springs extend forwardly from a pivot section midway along the body section to latching forward ends at the mating face of the connector assembly to latch with and be delatchable from corresponding posts of a mating connector. The latching springs include actuator sections exposed along the sides of the shell to be manually depressed to pivot the spring bodies and thus moving the latching forward ends apart to engage with and disengage from the posts during connector mating and unmating. During mating the spring latches are actuated by manual depression of the actuators to pivot outwardly the latching forward ends to pass by either conical or frustoconical forward ends of the posts as the connectors are urged together to mate, whereafter the actuators are released. The latching forward end of each spring latch is claw-like and includes a short transverse foot having a large wide notch thereinto to facilitate passing by the enlarged head, whereafter the transverse foot seats in the annular groove of the post just rearwardly of the forward post end. The spring latch is made of stainless steel alloy having a thickness of about 0.012 in., to have spring characteristics enabling deflection during mating to maintain at moderate levels the forces of resistance to mating generated by engagement of the spring latches with the posts during mating.

It is desired to eliminate the need to depress the actuator sections during mating while maintaining the retention strength of the latching springs against accidental unmating.

SUMMARY OF THE INVENTION

The spring latch of the present invention includes a latching forward end having a slot extending rearwardly from the short transverse forward end almost to the pivot section defined along the body section. The latching forward end is thus bifurcated into a pair of beams having respective feet that engage and bear against a respective tapered side surface of a conical or frustoconical forward end of a post of a mating connector as the connectors are urged together during connector mating, the beams thus self deflecting apart from each other until the feet seat in an annular groove rearwardly from the post forward end.

An embodiment of the present invention will now be described by way of example with reference to the accompanying drawings.

DETAILED DESCRIPTION

Figure 1:
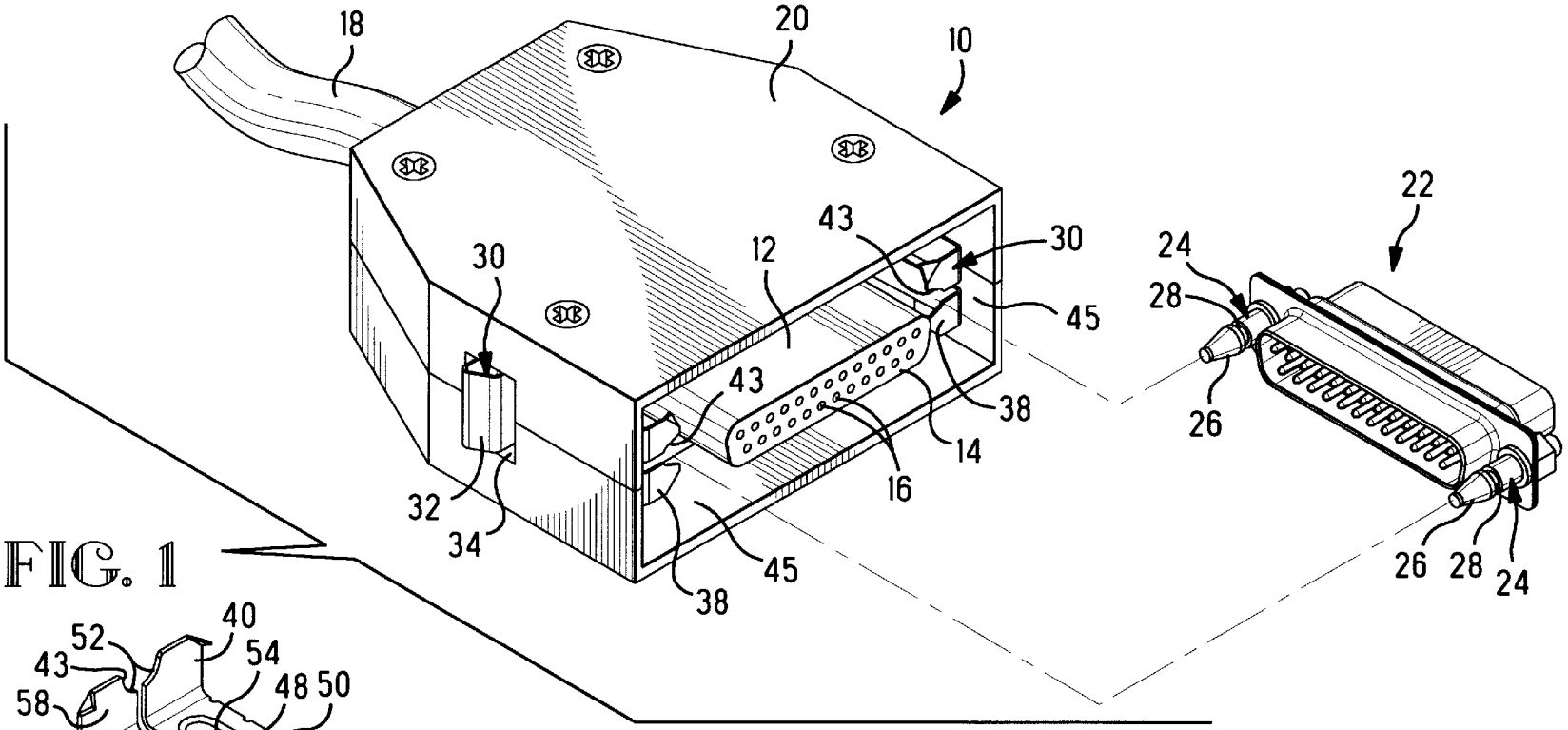
FIG. 1 is an isometric view of a connector assembly positioned to mate with a mating connector.
Figure 2:
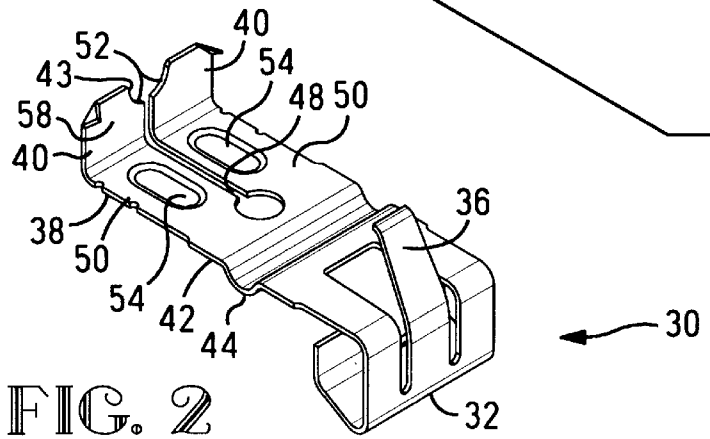
FIG. 2 is an isometric view of a spring latch of the present invention.

Electrical connector assembly 10 includes a primary connector having an insulative housing 12 in which are disposed a plurality of contacts extending rearwardly from mating face 14, with their contact sections recessed within passageways 16. A shell 20 encloses the housing and the terminations of conductors (not shown) of cable 18 with the contacts. A mating connector 22 is shown, having posts 24 extending forwardly from the mating face to either side of the contact array and extending along the direction of relative linear movement between the connector assembly and the mating connector during mating and unmating. The posts as shown have frustoconical forward ends 26 defining tapered bearing surfaces therealong extending rearwardly and outwardly and annular grooves 28 rearwardly therefrom. To either side of mating face 14 of housing 12 are respective spring latches 30 secured within shell 20. Actuator sections 32 at rearward ends of the spring latches 30 are seen projecting from sides of shell 16 through respective openings 34 thus enabling depression thereof to unmate the connector from mating connector 22. Biasing arms 36 press against surfaces of an inner shell wall to maintain the spring latches in their unactuated position, thus maintaining forward ends 38 of the spring latches in engagement with respective posts 24 of mating connector 22.

Figure 3:
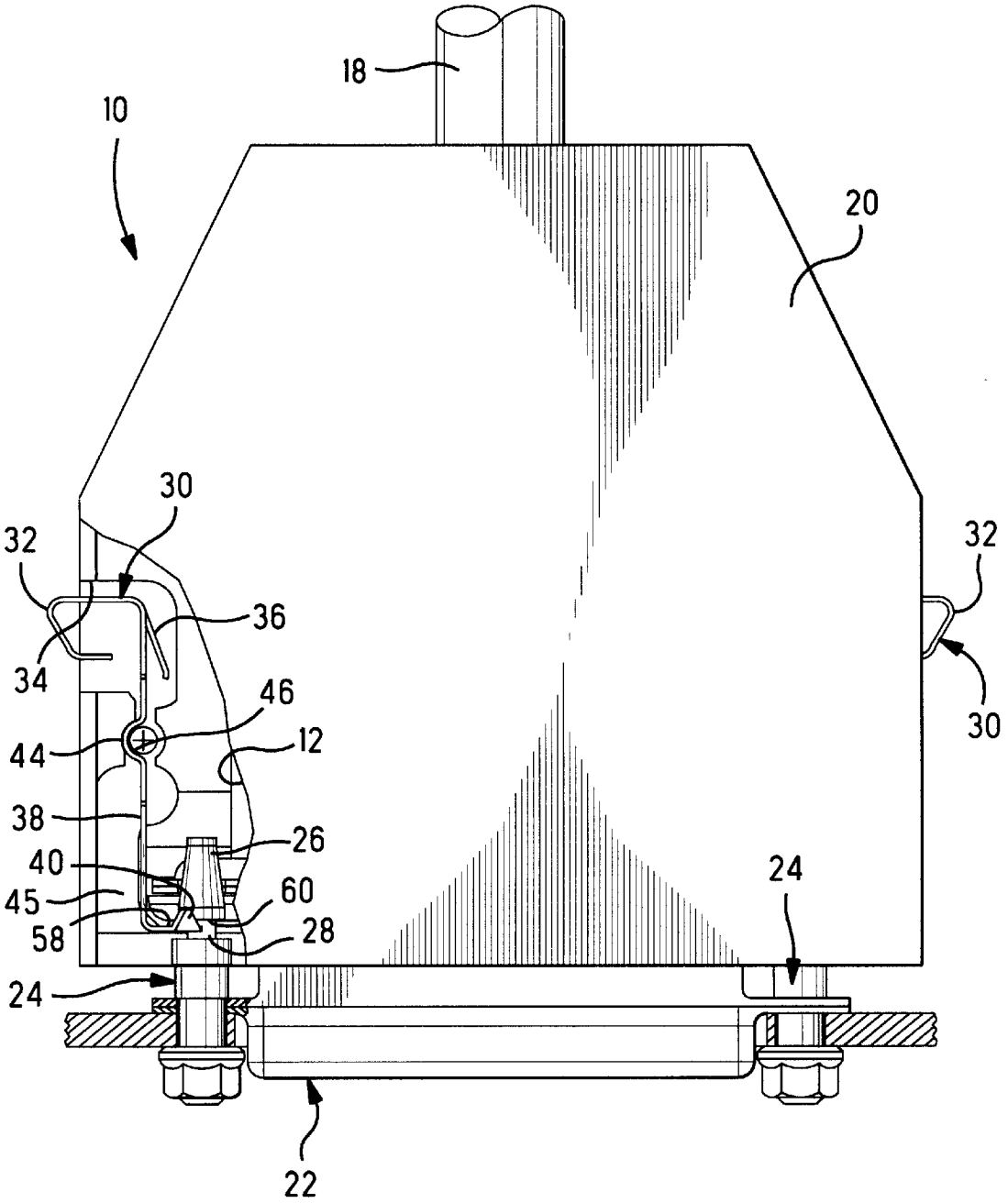
FIG. 3 is a plan view of the mated connectors with the shell partially broken away to reveal a spring latch of FIG. 2 mated with a post.
Figure 4:
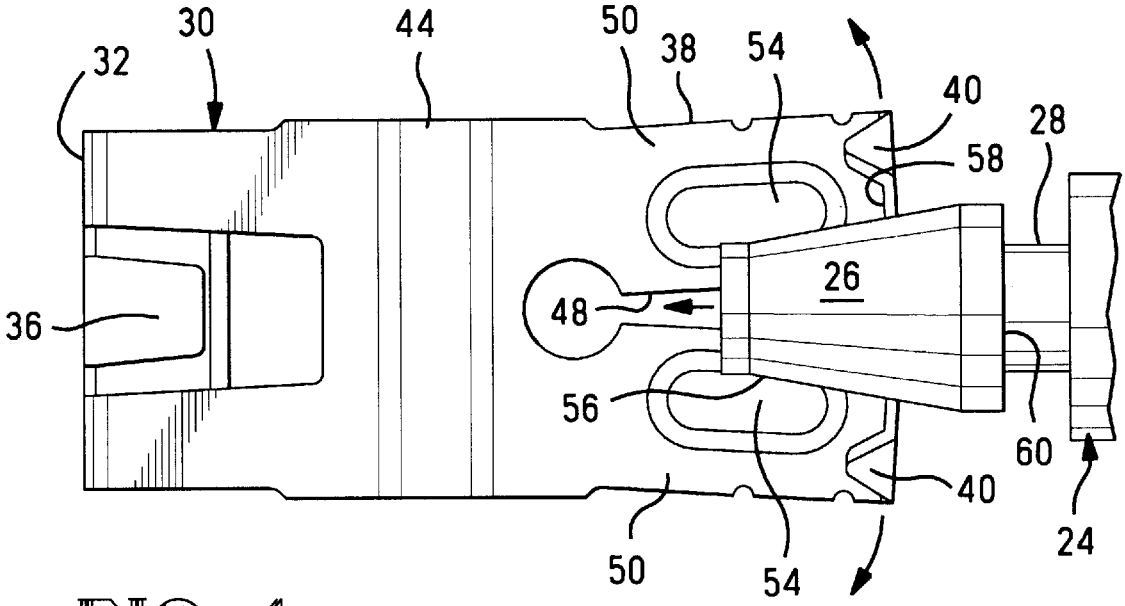
FIGS. 4 and 5 are enlarged side views of a spring latch of FIG. 2 engaging a post of the mating connector, and after full mating thereof, respectively.
Figure 5:
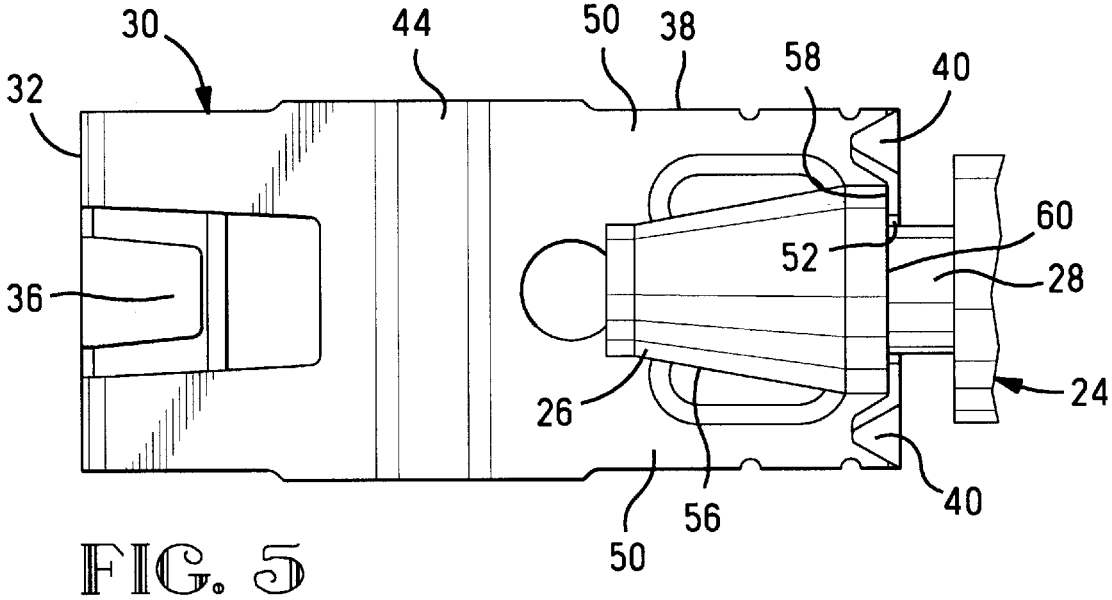

Forward ends 38 of spring latches 30 are engagement sections include short transverse feet 40 extending toward connector housing 12 and each other, and into latch post receiving cavities adjacent to housing 12 that seat within annular grooves 28 of posts 24 of connector 22 to latch the connectors in a mated relationship. Transverse feet 40 of each spring latch define between them a notch or cutout 43 larger in diameter than the diameter of an associated post at annular groove 28, enabling feet 40 to appropriately seat. Each spring latch 30 includes a body section 42 that defines a semicircular pivot section 44 that enables pivoting of the spring latch when actuator section 32 is depressed into shell 20, in cooperation with a complementary concavity 46 of shell 20 (see FIG. 3) as is known.

In accordance with the present invention, spring latch 30 includes a slot 48 extending from the notch in feet 40 preferably to pivot section 44, dividing forward end 38 into a pair of spaced beams 50 each having a respective foot 40. During connector mating, inner edges 52 of notch 43 defined by feet 40 engage and bear against the tapered surfaces along opposed sides of forward post end 26, deflecting the beams 50 apart without actuation of the actuating sections 32, and also deflecting them laterally to a limited extent against the spring bias of the biasing section 36. Upon full mating, feet 40 snap into and seat within annular groove 28 rearwardly of forward post ends 26, thereafter holding the connectors in mated engagement. Each beam may preferably include a strength rib 54 therealong for additional strength.

Figure 6:
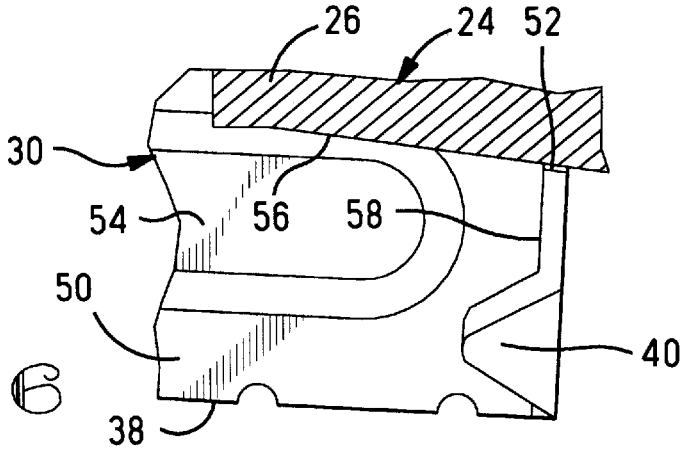
FIG. 6 is an enlarged view of a spring latch forward end adjacent a post head in cross-section.

Preferably, as shown in FIG. 6, the inner edge 52 of notch 43 of forward end 38 is coined to have an angle that complements the angle of the tapered surface 56 of a post head 26. With such an angle, upon initial engagement, minimized post scraping and no stubbing occurs and deflection becomes initiated. The nonstubbing nature of the spring latch, and the self-deflecting properties of the split beam design, enable the notch to be reduced in diameter to be just larger than the diameter of the post at annular groove 28. The reduced notch dimension allows feet 40 to be longer and more area of feet 40 to be received in annular groove 28, and thus more surface area of the top surfaces 58 of feet 40 are adjacent the oppositely facing surface 60 of enlarged forward post end 26 defining the front end of annular groove 28. The increased engagement area substantially enhances the retention capabilities of the spring latch of the present invention in maintaining the mated engagement of the connectors against stress applied on the connectors tending to pull them apart.

Variations and modifications may be made to the specific embodiment disclosed herein that are within the spirit of the invention and the scope of the claims.

What is claimed is:

1. An electrical connector assembly adapted for mating connection with a mating connector where the mating connector has a latch post extending along the direction of relative linear movement between the connector assembly and the mating connector during mating and unmating, the latch post having at its forward end an enlarged head having outwardly and rearwardly tapered surfaces therealong and an annular groove just rearwardly of said enlarged head, the assembly comprising:

a primary connector supporting a plurality of electrical terminals exposed along a mating face of the primary connector;

a two-part shell having an interior cavity encircling and containing the primary connector in a manner exposing said mating face thereof at a forward shell end, the shell further having an interior cavity open to said forward shell end for receiving a latch post into a respective latch post receiving cavity along each side of the primary connector; and metal unitary spring latches engageable with said latch posts and supported within said shell for pivotal movement about a pivot axis orthogonal to said direction of relative linear movement, each spring latch including a body section disposed generally in a plane adjacent a forward end, said body section having a pivot section between an actuating section at a rearward end thereof and an engagement section at a forward end thereof extending into said latch post receiving cavity and adapted for engagement with the latch post annular groove, said engagement end having feet extending out of a plane of said body section transversely with respect to said mating face, said feet being seatable into said annular groove of a said post of the mating connector upon mating, and said engagement end including a slot dividing said feet and extending rearwardly along said body section, said slot dividing said engagement section into a pair of beams that each include a respective said foot and a rib, whereby upon engagement of inner edges of said feet of each spring latch with tapered surfaces of a said post forward end, said beams are deflectable laterally apart without actuation of said actuation section while bearing against said tapered surfaces until seating in said annular groove.

2. The connector assembly as set forth in claim 1, wherein said feet of each said spring latch define a notch dimensioned just larger than a diameter of a corresponding said post at said annular groove, and said notch is in communication with said slot.

3. The connector assembly as set forth in claim 1, wherein inner edges of said notch are coined to define an angle complementary to the angle of the tapered surface of the enlarged head of a respective said post of said mating connector.

4. A metal unitary spring latch for an electrical connector assembly, the assembly being adapted for mating connection with a mating connector where the mating connector has a latch post extending along a direction of relative movement between the connector assembly and the mating connector during mating and unmating, the latch post having at a forward end an enlarged head having outwardly and rearwardly tapered surfaces therealong, said spring latch comprising:

a body section disposed generally in a plane adjacent a forward end, said body section including a pivot section between an actuating section at a rearward end and an engagement section at a forward end, said pivot section being cooperable with said connector assembly to pivot the spring latch during unmating upon actuation of said actuation section, and said engagement section being bifurcated and having a pair of beams coextending to conclude in respective transverse feet extending out of a plane of said body section, said beams and said feet being divided by a slot extending rearwardly toward said pivot section, said each beam having a rib and said beams being deflectable laterally apart without actuation of said actuation section during mating upon engagement with and bearing against tapered surfaces of said enlarged post head until seating in said annular groove rearwardly thereof.

5. The spring latch as set forth in claim 4, wherein said feet of said spring latch define a notch dimensioned just larger than a diameter of a corresponding said post at said annular groove, and said notch is in communication with said slot.

6. The spring latch as set forth in claim 4, wherein inner edges of said notch are coined to define an angle complementary to the angle of the tapered surface of the enlarged head of a respective said post of said mating connector.

* * * * *